United States Patent [19]

Yokota et al.

[11] 4,008,024

[45] Feb. 15, 1977

[54] APPARATUS FOR PRODUCTION OF GAS-PERMEABLE SEAMLESS PIPES

[75] Inventors: Sadaaki Yokota, Iwakuni; Shinzi Hayata, Waki; Toshio Kaya, Iwakuni, all of Japan

[73] Assignee: Mitsui Petrochemical Industries, Ltd., Tokyo, Japan

[22] Filed: Dec. 2, 1975

[21] Appl. No.: 637,086

[30] Foreign Application Priority Data

Dec. 9, 1974 Japan ..... 49-140445
Dec. 14, 1974 Japan ..... 49-143053
Sept. 22, 1975 Japan ..... 50-113673

[52] U.S. Cl. ..... 425/85; 425/DIG. 60; 425/371; 425/403

[51] Int. Cl.[2] ..... B29C 11/00; B29D 23/00; B29J 5/00

[58] Field of Search ..... 425/84, 85, DIG. 60, 425/371, 403

[56] References Cited

UNITED STATES PATENTS 2,731,699 1/1956 Dubbs ..... 425/85
2,961,043 11/1960 Hicks ..... 425/85 X
3,748,072 7/1973 Whelan ..... 425/85

*Primary Examiner*—J. Howard Flint, Jr.
*Attorney, Agent, or Firm*—Sherman & Shalloway

[57] ABSTRACT

A gas-permeable seamless pipe structure formed in a pipe shape by a wet process comprising (A) 20 to 95% by weight of thermoplastic fibers and (B) 5 to 80% by weight of a component consisting of (a) 20 to 100% of other fibers being infusible at the fusing temperature of said thermoplastic fibers (A) or having a higher melting point than said thermoplastic fibers (A) and (b) 0 to 80% by weight of a void-containing particulate material having an apparent density of not more than 1 and an average particle size of 20 to 2,000 microns and being infusible at the fusing temperature of said thermoplastic fibers (A), said thermoplastic fibers (A) being bonded to the other component (B) as a result of heat fusing; a method for producing the pipe structure; and an apparatus for use in this method. The pipe structure has superior physical properties such as strength and hardness, good water resistance, light weight and superior gas-permeability.

2 Claims, 3 Drawing Figures

Figure 2:
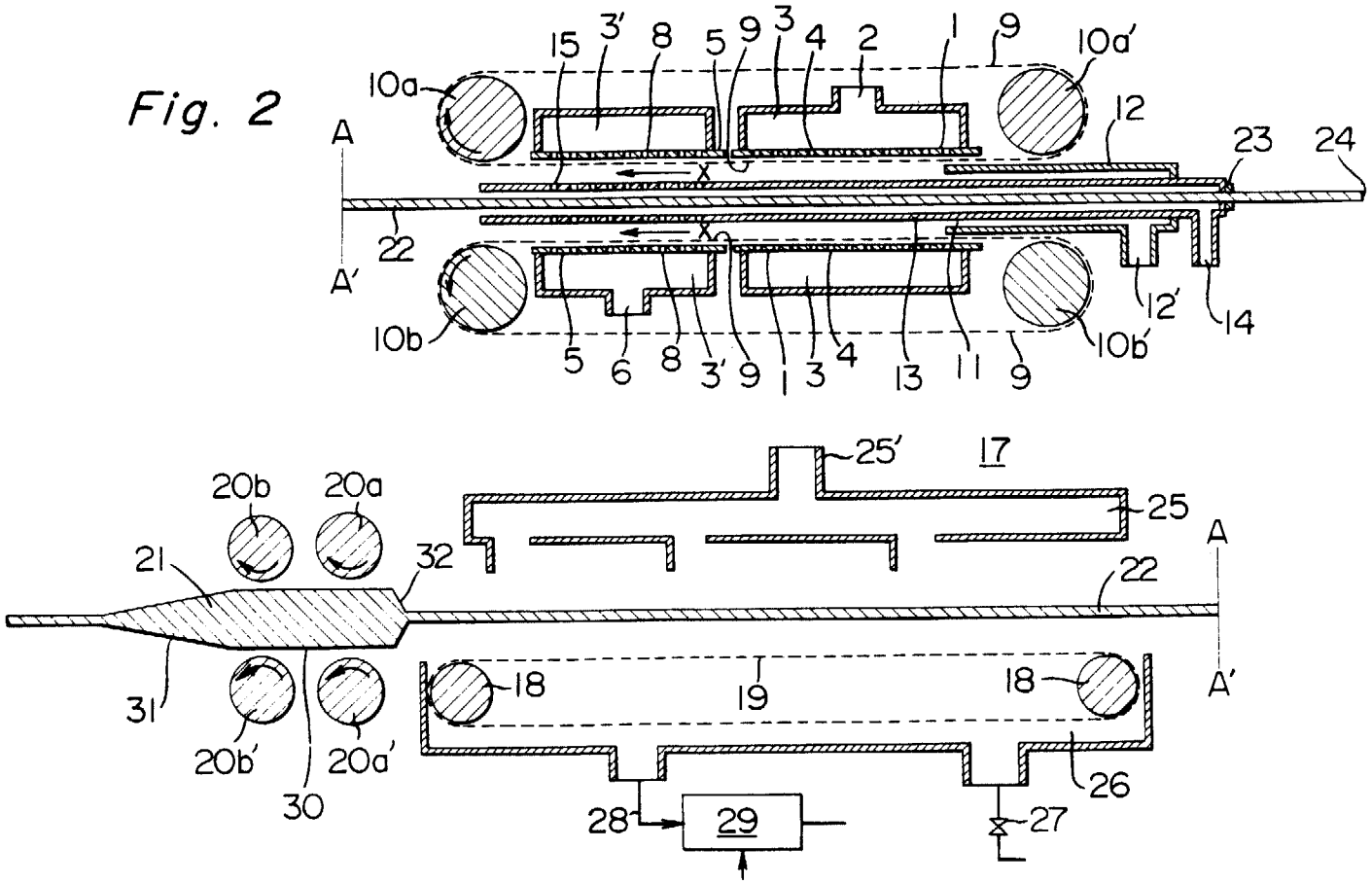

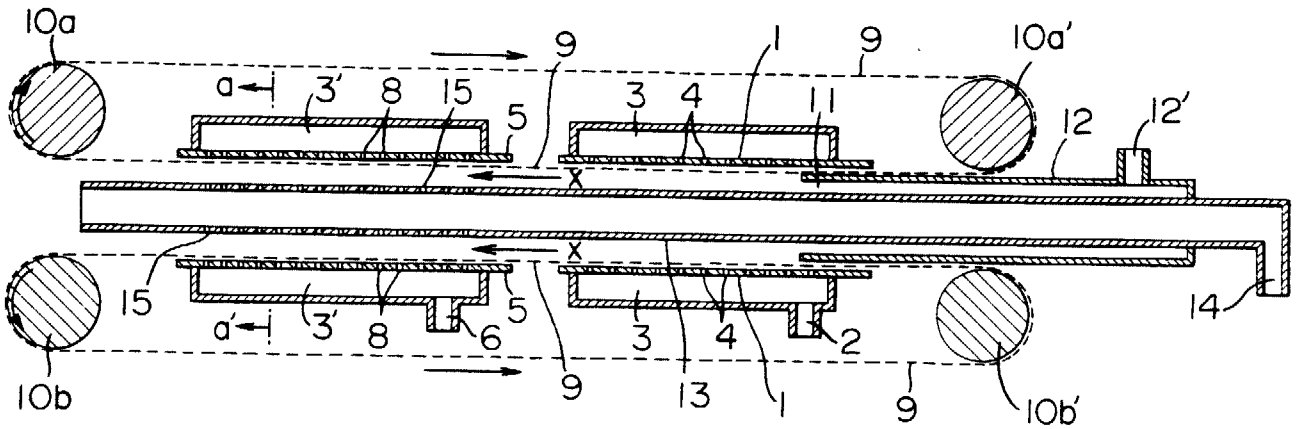
Fig. 1-A
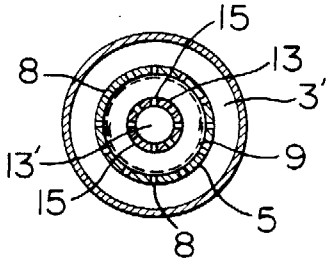
Fig. 1-B

APPARATUS FOR PRODUCTION OF GAS-PERMEABLE SEAMLESS PIPES

This invention relates to a seamless pipe structure formed by a wet process which has superior physical properties such as strength and hardness, good water resistance that enables these properties to be retained in the wet state, light weight, and superior gas-permeability, a method for producing the pipe structure, and an apparatus suitable for use in this method.

Because of these favorable properties, the gas-permeable seamless pipe structure of this invention is useful in a wide range of applications. For example, it can be used for uniformly blowing a gas into the liquid phase of an aerator tank, a fish cultivating tank or a cultivation tank for aerobic microorganisms, for supplying or collecting liquids in agriculture and horticulture and in various underdrainage systems, or for removing liquid or solid foreign matters in gases or liquids by permitting them to flow therethrough. Furthermore, it can be used for an in-water fertilizer applying method in which a water-soluble fertilizer or the like is filled in the pipe structure and the pipe is immersed in water, in a method for growing mushrooms in which the fungal cells are cultivated in the pipe structure to allow the mushrooms to grow out from its outer surface, or a support of a dialysis membrane such as reverse osmatic membranes.

Pipe structures made of a fibrous material have previously been known. These structures are produced, for example, by drying a sheet-like material pre-formed by a wet process, cutting the dried sheet-like material into tapes of the desired width, wrapping the tapes in a helical shape around a mandrel so that their end edges in the widthwise direction are superimposed on one another, and bonding the superimposed portions to form a pipe-like structure. Such pipe-like structures necessarily have a seam ascribable to the superimposed portions.

We made extensive investigations in order to provide a gas-permeable pipe structure made of a fibrous material, which is free from such a seam and has superior physical properties such as strength and hardness, superior water resistance, and superior gas-permeability, and which is useful for conducting a gas or liquid into and from it through its wall. As a result, we found that a pipe structure free from seams in its wall can be obtained continuously be a wet process by feeding a slurry consisting of (A) at least 20% by weight of thermoplastic fibers, (B) a component consisting of other fibers being infusible at the fusing temperature of the thermoplastic fibers (A) or having a higher melting point than the thermoplastic fibers and if required, a void-containing low-density particulate material, and (C) a liquid medium onto the inner wall surface of a moving tubular shaping screen, exerting a sucking action on the slurry from the outer wall surface of the shaping screen to deposit the solid component of the slurry onto the inner wall surface of the shaping screen, especially preferably supplying a gaseous stream to the inside of the wet pipe structure deposited on the inner surface of the moving tubular shaping screen and exerting a sucking action on the pipe structure at this site from its outside to pass the gas forcibly through the wall of the structure, and thus, removing the deposited pipe structure from the inner wall surface of the tubular shaping screen at the end of the tubular passageway of the shaping screen.

It has also been found that a gas-permeable seamless pipe structure having the superior properties as mentioned above can be obtained by heating the removed pipe structure at a temperature above the melting point of the thermoplastic fibers (A) but below the melting point of the component (B) thereby to fuse the thermoplastic fibers to the other component (B) and bond them together.

The pipe structure of this invention is characterized in that its wall is free of seams since it is formed in one step by a wet process; and that since the thermoplastic fibers contained in the pipe structure are fused and bonded to the other component (B) firmly throughout the entire structure, and the pipe structure contains the other fibers and if required, the low-density void-containing particulate material, it has good water resistance, sufficient strength, light weight, and superior gas-permeability. Furthermore, the gas-permeability of the pipe structure of this invention is inherent to its own structure, and is not imparted by a post treatment which, for example, comprises providing a number of gas-permeable pores on the pipe structure, or forming the pipe from a material which contains a soluble component and then removing the soluble component by using a solvent thereby to form pores. The pipe structure of this invention having such properties has not been known heretofore.

Accordingly, it is an object of this invention to provide a new pipe structure having superior physical properties such as strength and hardness, good water resistance that enables these physical properties to be retained in the wet state, light weight, and high gas-permeability and being free from seams, which is produced in one step by a wet process and then heat-treating the resulting pipe structure.

Another object of this invention is to provide a method for continuously producing this pipe structure, and an apparatus suitable for use in the performance of this method.

The gas-permeable seamless pipe structure of this invention comprises (A) 20 to 95% by weight, preferably 50 to 85% by weight, of thermoplastic fibers and (B) 5 to 80% by weight, preferably 15 to 50% by weight, of a component consisting of (a) 20 to 100% by weight of other fibers being infusible at the fusing temperature of the thermoplastic fibers (A) or having a higher melting point than the thermoplastic fibers (A) and (b) 0 to 80% by weight of a void-containing particulate material having an apparent density of not more than 1 and an average particle size of 20 to 2,000 microns and being infusible at the fusing temperature of the thermoplastic fibers (A). More preferably, it comprises 40 to 75% by weight of thermoplastic fibers (A), 5 to 30% by weight of the other fibers (a) and 15 to 50% by weight of the particulate material (b).

This pipe structure is formed in a pipe shape in one step by a wet process, and is not one formed by first preparing a sheet-like structure and then forming it into a pipe shape. The "wet process" denotes such a process as one used for making paper from a paper-making pulp slurry. In the present invention, the starting materials are shaped in one step by a wet process into a pipe structure without first forming them into a sheet-like structure. Accordingly, the resulting pipe structure is free from seams at its wall. In the pipe structure of this invention, the thermoplastic fibers (A) are bonded with the other conponent (B) throughout the pipe structure as a result of the heat-fusing of the thermoplastic fibers at a temperature above the melting point of the thermoplastic fibers (A). The pipe structure of this invention, preferably its wall, has good gas-permeability expressed by a gas-permeability of not more than 200 seconds as determined by a Gurley method (Japanese Industrial Standard P 8117 corresponding to TAPPI Standard 460 0S-68).

In the pipe structure of this invention, the thermoplastic fibers (A) preferably have an average fiber length of about 0.5 to about 50 mm, and an average fiber diameter of about 5 to about 100 microns. The amount of the thermoplastic fibers (A) is at least 20% by weight, based on the weight of the pipe structure, in order to impart the desired mechanical strength and water resistance. Preferably, the amount is about 40 to about 75% by weight, especially preferably about 50 to about 85% by weight. Since the thermoplastic fibers (A) also serve as a fibrous binder as a result of melting, they are preferably those derived from a thermoplastic synthetic resin capable of fusing or melting at a temperature of about 100° to about 300° C. Examples of the thermoplastic synthetic fibers are fibers of a polyolefin such as low-density, medium-density or high-density polyethylene, polypropylene, poly-1-butene, poly-4-methylpentene-1, an ethylene/propylene copolymer, an ethylene/1-butene copolymer, polystyrene or an ethylene/vinyl acetate copolymer, fibers of a halogen-containing vinyl polymer such as polyvinyl chloride or polyvinylidene chloride, fibers of a polyamide such as nylon 6, nylon 66, nylon 610 or nylon 12, and fibers of a polyester such as polyethylene terephthalate, polyethylene terephthalate/isophthalate, polytetramethylene terephthalate, a tetramethylene terephthalate/ethylene terephthalate copolymer, or a polytetramethylene terephthalate/polyoxytetramethylene glycol block copolymer.

The other fibers (a) in the component (B) of the pipe structure of this invention may be organic fibers, inorganic fibers or mixtures thereof. The other fibers are infusible at the fusing temperature of the thermoplastic fibers (A) or have a higher melting point than the thermoplastic fibers (A). Examples of such other fibers are inorganic fibers such as glass fibers, rock wool or asbestos, metallic fibers, cellulosic fibers such as paper-making wood pulp, regenerated pulp, bark fiber pulp, or cotton linter, and synthetic fibers such as polyolefin fibers, polyvinyl formal fibers, acrylic fibers, aromatic polyamide fibers, polyimide fibers, or aromatic polyester fibers.

Preferably, the thermoplastic fibers (A) have a relatively low melting point and the other fibers (a) have a relatively high melting point, thus using the former as a binder and the latter as a reinforcing material. Suitable combinations of the fibers (A) and the fibers (a) are, for example, a combination of low-density or medium-density polyethylene fibers and polypropylene fibers, a combination of medium-density or high-density polyethylene fibers and polyvinyl formal fibers, a combination of polypropylene fibers and polyvinyl formal fibers, a combination of copolyester fibers such as polyethylene terephthalate/isophthalate fibers and polyethylene terephthalate fibers, and a combination of polyamide fibers having a relatively low melting point such as polylaurolactam (nylon 12) and polyamide fibers having a relatively high melting point such as polycaprolactam (nylon 6) or polyhexamethylene adipamide (nylon 66).

The component (B) of the pipe structure of this invention may comprise the void-containing particulate material (b) in addition to the other fibers (a). Examples of the particulate material (b) are vitreous or inorganic hollow microspheres such as expanded volcanic ash ("Shirasv" balloons), silica-alumina balloons, microballoons or foamed perlite, hollow microspheres of thermosetting resins such as phenol resins, urea resins or epoxy resins, and hollow microspheres of carbon, which have the apparent densities and particle sizes specified hereinabove. These hollow microspherical fillers are uniformly miscible with the above-described fibers and form a stable slurry. Use of such a slurry can afford a pipe structure having superior gas-permeability in spite of having a large wall thickness.

The gas-permeable seamless pipe structure of this invention can be produced by feeding a slurry consisting of the thermoplastic fibers (A), the component (B) and a liquid medium (C) onto the inner wall surface of a tubular shaping screen moving in its longitudinal direction, exerting a sucking action on the slurry from the outer wall surface of the moving tubular shaping screen to deposit the solid component of the slurry onto the inner wall surface of the shaping screen, preferably feeding a gaseous stream to the structure deposited in pipe form on the inner surface of the screen from the inside of the pipe structure and exerting a sucking action on the pipe structure from its outside, removing the deposited pipe structure from the inner wall surface of the moving tubular shaping screen at the downstream terminal portion of a tubular passageway of the shaping screen while maintaining the pipe-like form, and heating the removed pipe structure at a temperature above the melting point of the thermoplastic fiber component (A) but below the melting point of the component (B).

Water is most advantageously used as a liquid medium (C) for use in forming the above slurry. Organic solvents such as paraffinic or aromatic hydrocarbons may also be used as the liquid medium. When a volatile liquid such as LPG, propane or butane is used as the slurry-forming liquid medium, the drying of the pipe structure formed by the wet process is done easily. The solids concentration of the slurry is not particularly limited, but generally, it is preferred to set the concentration at 0.1 to 10% by weight, especially 0.5 to 5% by weight, based on the weight of the slurry.

In order to form the slurry, various types of beaters such as a Hollander type, ball mill type or rod mill type can be used. Furthermore, a nonionic, cationic, anionic or amphoteric surface active agent, rosin or other additives may be incorporated in the slurry in order to improve its stability or shapability.

The amount of the solid deposited on the inner wall surface of the moving tubular shaping screen can be varied properly according to the intended use of the resulting seamless pipe structure. From the standpoint of the mechanical strength or durability of the pipe structure, the amount is desirably at least 0.02 g/cm$^2$, and amounts exceeding 2 g/cm$^2$ are not preferred from the standpoint of the gas-permeability of the pipe wall surface, and also from economic viewpoints. In order to achieve an optimum combination of porosity and mechanical, strength, it is desirable to choose the composition of the slurry and the conditions for forming the pipe structure by a wet process so that the apparent density of the wall of the resulting pipe structure becomes generally 0.2 to 0.8 g/cc.

The seamless pipe just removed from the inner wall surface of the shaping screen while maintaining the pipe structure has a considerable portion of its free water removed, but if desired, it may be dried in a drying oven at a temperature of generally 60° to 180° C. at atmospheric or reduced pressure. The seamless pipe structure removed from the inner wall surface of the shaped screen and optionally dried is then heat-treated at a temperature above the melting point of the thermoplastic fibers (A) but below the melting point of the component (B). The heat-treatment temperature for the seamless pipe naturally differs according to the type of the fibers (A) used. Generally, it is preferred to select the type of the thermoplastic fibers (A) so that the heat fusing of the fibers (A) is effected at a temperature of 100° to 300° C., especially 150° to 250° C. The fibers (A) can be heat-fused uniformly in the thickness direction of the pipe wall. If desired, however, the heat fusion can be performed preferentially at the inner and outer surfaces of the pipe wall or portions near them.

The heat-treatment of the pipe structure can be carried out using any desired heating means. For example, the pipe structure is placed on a heated mandrel, and heat-treated by the transmission of heat from it. Or heating can also be carried out by high frequency heating, rediation heating, hot air heating or steam heating. The drying of the pipe structure and the heat fusing of the thermoplastic fibers (A) may be effected in separate steps or simultaneously in a single step.

Thus, according to this invention, there is provided a gas-permeable seamless pipe structure composed of thermoplastic fibers (A) as fiber matrix and other fibers (a) and optionally the low-density particulate material (b) uniformly dispersed in the matrix, the fiber matrix being integrated at many points by the heat fusion of the thermoplastic fibers (A). The pipe structure has high gas-permeability because of the above-mentioned structure, and high water resistance as a result of the heat fusion of the thermoplastic fibers to form an integrated structure. Pipe structures having a small Gurley value, that is, having good gas permeability, are permeable not only to gases but also to liquids such as water. The gas permeability of the seamless pipe structure can be adjusted not only by changing the composition of the slurry or the wet-process conditions, but also by a press method involving exerting a compression force from inner and outer surface of the pipe structure at the time of heat fusion or by a method comprising immersing the pipe structure in a dilute solution or emulsion of a resin.

The production of the gas-permeable seamless pipe structure of this invention and several modes of an apparatus for use therein will be described below by reference to the accompanying drawings in which FIG. 1-A is a schematic sectional view showing one example of an apparatus suitable for use in the production of the pipe structure of this invention; FIG. 1-B is a sectional view taken along the line *a–a'* of FIG. 1-A; and FIG. 2 is a schematic sectional view, similar to FIG. 1-A, showing another example of the apparatus.

The apparatus shown in the drawings include a tubular shaping screen 9 movable in its axial direction; a suction chamber 3 provided upstream in the moving direction of the screen so as to surround the outer wall surface of the shaping screen 9 and adapted to suck the solid component of a slurry consisting of (A) thermoplastic fibers, (B) other fibers with or without a void-containing low-density particulate material and (C) a liquid medium toward the inner wall surface of the shaping screen 9 and deposit it thereon in the shape of a pipe structure; a slurry feed means 12 for feeding the slurry to the inner wall surface of the shaping screen near the suction chamber 3 upstream in the moving direction of the screen; a core member in a tubular passageway formed by the tubular shaping screen 9, said core member being disposed along the axial direction of the passageway and spaced from the inner wall surface of the shaping screen; and a heating means for withdrawing the resulting pipe structure from the terminal portion of the tubular passageway, and heat-fusing the thermoplastic fibers (A) of the pipe structure.

In the embodiment shown in FIG. 1-A, the heating means is not shown, and in the embodiment of FIG. 2, one example of heating means is shown in the bottom half. In FIGS. 1-A, 1-B and 2 showing preferred embodiments, the core member 13 is of a hollow structure, and a number of small apertures 15 for releasing a gas are provided on the pheripheral wall of the hollow core member 13 and a suction chamber 3' is provided around the periphery of the outer wall surface of the shaping screen 9 at a position opposite to the apertured part of the core member 13.

In the embodiment shown in FIGS. 1-A and 1-B, a tubular shaping screen 9 movable in the axial direction of its tubular form can be made up of a plurality of, preferably two, net-like belts movable continuously or intermittently along the inner surface of an annular member 1 having a number of small suction aperture 4 which forms a suction chamber 3 surrounding the outer wall surface of the screen 9. Pairs of pulleys 10*a*, 10*a'* and 10*b*, 10*b'* are provided for moving the shaping screen 9. For example, by rotating the pulleys 10*a* and 10*b* by a suitable drive mechanism (not shown), the tubular shaping screen 9 can be moved in its axial direction as indicated by arrow *x* in the drawing. The widths of net-like belts are such that a combination of two or more of the net-like belts can afford a tubular shape. The net-like belts may be made of any material which can be rendered permeable to liquids, has such suitable flexibility as to enable it to be formed into a tubular shape, and is insoluble in the liquid medium of the slurry. The mesh size of the net-like belt is such that permits the solid component in the slurry to be deposited on the inner wall surface of the shaping screen 9 and the liquid medium in the slurry to be easily sucked therethrough. For example, the mesh size is 10 to 200 mesh (Tyler mesh), preferably about 30 to about 60 mesh. Examples of the material for the net-like belt are knitted or woven fabrics, preferably plain gauzes, of natural or synthetic fibers such as silk, nylon, polyester or polyvinyl formal fibers, metallic nets such as stainless steel, brass or copper nets, and knitted fabrics of a mixture of these fibers and metals.

Upstream in the moving direction (the same direction as that shown by arrow *x* in the drawing) of the shaping screen 9, a suction chamber 3 for sucking the solid component of the slurry and depositing it in the form of a pipe structure onto the inner wall surface of the shaping screen 9, and also sucking the liquid medium of the slurry and separating it from the solid component is provided around the outer wall surface of the shaping screen 9. The cross sectional shape of the tubular shaping screen 9 is not limited to a circular shape, but any desired shape conforming to the cross sectional shape of the intended pipe structure. The cross sectional shape of the annular member 1 having a number of suction apertures 4 formed therein and constituting the suction chamber 3 may also be of any desired shape conforming to the cross sectional shape of the shaping screen 9. The number of suction chamber 3 is not limited to one, but a plurality of suction chambers can be provided surrounding the outer wall surface of the tubular shaping screen 9. In one embodiment, a plurality of suction chambers are provided, and the degree of vacuum in the suction chambers is increased progressively in the moving direction of the shaping screen 9 so that the pipe structure deposited on the inner wall surface of the shaping screen 9 undergoes a progressively stronger sucking action as it moves in the moving direction of the shaping screen 9.

In a tubular passageway formed by the shaping screen 9, a core member 13 is provided in the axial direction of the passageway at a position spaced away from the inner wall surface of the shaping screen 9 so as to maintain a slurry flow passage within the slurry feed means 12 and the shaping screen 9 annular in cross section. In an especially preferred embodiment of this invention, the core member 13 is hollow in structure, and at a downstream position in the tubular passageway, a number of small apertures 15 for releasing a gas are provided on the peripheral wall of the hollow core member 13, and surrounding the outer wall surface of the shaping screen at a position opposite to these apertures, a suction chamber 3′ of the same structure as the suction chamber 3 is provided. One or a plurality of the suction chambers 3 and the suction chamber 3′ may be constructed in an integral unit. Preferably, however, they are provided separately from each other. In the drawing, suction chamber 3′ having an annular member 5 with a number of small apertures 8, similar in structure to the annular member 1, is shown. Upstream in the moving direction of the shaping screen 9 a slurry feed means 12 for feeding the slurry onto the inner wall surface of the shaping screen near the suction chamber 3 is provided. Desirably, a slurry feed opening 11 of the feed means 12 extends to the suction chamber 3 in proximity to the inner wall surface of the shaping screen 9 while allowing the shaping screen 9 to be movable. In the drawing, the slurry feed opening 11 extends to a position which overlaps the end portion of the annular member 1 constituting the suction chamber 3.

The lower part of FIG. 2 shows one example of a heating means for heat-fusing the thermoplastic fibers (A) after withdrawing the pipe structure formed on the inner wall surface of the shaping screen 9 at the terminal portion of the tubular passageway. The upper part of FIG. 2 shows an apparatus, similar in structure to the apparatus shown in FIG. 1, for forming a pipe structure on the inner wall surface of the moving tubular shaping screen 9 by a wet process. In the embodiment of FIG. 2, a supporting arm 22 for a press core 21 extends through the hollow shaft of the core member 13. As shown, the arm 22 extends through a heating oven 17. The heating means may be any means by which a part or the whole of the thermoplastic fibers (A) can be heat-fused. In the example shown in FIG. 2, the heating oven 17 permits the passing of hot air therethrough so that it is suitable for heating the pipe structure uniformly. The heating oven 17 is provided inside a passageway for the pipe structure consisting of an endless screen conveyor 19 to be supported and driven by a pair of rollers 18, and a hot air supply section 25 and an exhaust section 26 are provided in a manner to interpose the passageway therebetween. By blowing hot air against the pipe structure from the hot air supply section 25, the drying of the pipe structure and the melting of the thermoplastic fibers (A) in the structure can be performed. A part of the exhaust gas introduced into the exhaust section 26, especially the exhaust gas containing moisture, is discharged into the atmosphere through an exhaust valve 27. The remainder of the exhaust air, especially when it has a low moisture content, can be recycled together with a combustion gas from a burner 29 to the hot air supply section 25 through a circulating pipe 28 and a hot air feed opening 25′.

In the embodiment shown in FIG. 2, a press device is provided downstream of the heating oven 17, and two pairs of press rolls 20*a*, 20*a*′ and 20*b*, 20*b*′ are provided. Each of the press rolls has a concave surface at its periphery, and its rotating direction corresponds with the downstream direction. By means of a pair of press rolls, a cross-sectional surface having a shape and a size substantially corresponding with those of the outer wall peripheral surface of the pipe structure can be formed. When two or more pairs of press rolls, for exmple, two pairs of rolls, are used, the positions of the roll pairs may be changed so that the pressing can be carried out uniformly along the peripheral surface of the pipe structure. For example, rolls in one pair are provided vertically, and rolls in the other pair, laterally. It is also possible to perform the pressing of the product to a greater extent by reducing the size of the press rolls progressively in the downstream direction.

Within the press device, the press core 21 is disposed as supported on the supporting arm 22 extending through the heating oven and the core member 13 within the tubular shaping screen 9. A stopper 23 is provided in the supporting arm 22 at the upstream end of the hollow core member 13. The press core 21 is fixed by the stopper 23. When the thermoplastic fibers (A) are in the molten state in the heating oven 17, the pipe structure is likely to contact the supporting arm 22 and melt-adhere to it. If desired, in order to avoid this likelihood, the press core 21 and the supporting arm 22 may be constructed in a hollow shape so as to allow a cooling medium such as water to pass therethrough and to maintain the surface temperatures of the supporting arm and the press core at a point below the melting point of the thermoplastic fibers (A).

Preferably, in connection with the stationary provision of the rotating shafts of the two pairs of press rolls 20*a*, 20*a*° and 20*b*, 20*b*′, the clearances between the press core 21 and the press rolls are rendered adjustable by rendering the press core 21 and the press core supporting arm 22 longitudinally slidable, and moving the press core 21 in the longitudinal direction. For this purpose, the press core 21 is made up of cylindrical part 30 having a predetermined diameter and a tapered part 31 downstream of the cylindrical part 30, and a slide bearing (not shown) is provided between the stopper 23 and the supporting arm 22. Moving the tapered part 31 in the longitudinal direction permits the free adjustment of clearances between the press core 21 and the press rollers.

Desirably, an elongated portion 32 with increasing width toward one end is provided upstream of the cylindrical part 30 in order to facilitate the guiding of the pipe structure to the press core 21.

In operation, a slurry consisting of 20 to 95% by weight of component (A) and 5 to 80% by weight of component (B) and a liquid medium (C) is fed to the slurry feeding means 12 from the opening 12'. Suction openings 2 and 6 of the suction chambers 3 and 3' are connected to a suction means (now shown). Though the annular passageway of the slurry feed means 12, the slurry flows out from the feed opening 11. Since a sucking action is exerted on the flowing slurry through the tubular shaping screen moving in the direction of arrow *x* and a number of small apertures 4 provided in the annular member 1 of the suction chamber 3, the solid component in the slurry is continuously deposited on the inner wall surface of the moving tubular shaping screen. The liquid medium (e.g., water) of the slurry which serves as a carrier is drawn into the sucking chamber 3, and thus, a pipe-shaped structure is formed on the inner wall surface of the shaping screen by the wet process. The thickness of the wall of the pipe structure can be adjusted suitably by changing the slurry feed speed and/or the moving speed of the shaping screen 9. The shaping screen 9 can be moved either intermittently or continuously. But when it is desired to render the distribution of the deposited fibers uniform throughout the pipe structure, the shaping screen 9 is preferably moved continuously. Usually, it takes about 1 to 40 seconds for the pipe structure deposited on the inner wall surface of the shaping screen 9 to pass through the site of the suction chamber 3. The average moving speed of the screen 9, i.e. the average withdrawing speed of the pipe structure, varies greatly according to various factors such as the slurry feeding speed, the concentration of the solids in the components (A) and (B), the desired thickness of the pipe structure, the desired thickness of the pipe wall, and the degree of air-permeability of the pipe structure. But it is determined so as to satisfy the following equation.

$$V_1 = \frac{C \cdot V_2}{d \cdot S}$$

wherein $V_1$ is the speed (cm/sec.) of withdrawing the pipe structure, $C$ is the concentration in weight of the thermoplastic fibers (A) in the slurry, $V_2$ is the speed (g/sec.) of feeding the slurry, $d$ is the filling density (g/cc) of the wall of the pipe structure, and $S$ is the sectional area ($cm^2$) of the wall of the pipe structure.

In a preferred embodiment of this invention, a suction chamber 3', similar in structure to the suction chamber 3, is provided downstream in the tubular passageway and exerts a sucking action on the pipe structure deposited on the inner wall surface of the moving tubular shaping screen 9 from its outside. At the same time, a number of small apertures 15 are provided at that part of the core member 13 which is opposite to the suction chamber 3' to allow a gas, preferably a heated gas, such as air or heated air, or steam from the gas inlet opening 14 to be issued therefrom. This construction allows the gas to be passed forcibly through the wall of the wet pipe structure deposited on the shaping screen 9. This leads to the drying of the pipe structure to render it sufficiently self-supporting until it is subjected to a subsequent heating step for fusing the thermoplastic fibers (A), and to the microscopic rearrangement of the component (B) in the solid component of the slurry deposited on the inner wall surface of the shaping screen 9 to make the pipe structure highly permeable to gases.

The difference in pressure between the hollow core member 13 and the suction chamber 3' may be such that permits the gases to pass through the wall of the wet pipe structure. Extremely large pressure differences are not required. By elevating the pressure of the gas to be fed to the hollow core member 13 to a pressure somewhat higher than atmospheric pressure, and reducing the pressure inside the suction chamber 3' to a pressure somewhat lower than atmospheric pressure, the pipe structure can be rendered highly gas-permeable and the moisture of the pipe structure can be effectively reduced. Generally, pressure differences in the range of 0.3 to 3 $Kg/cm^2$ suffice for the purpose of this invention. Desirably, the moisture content of the pipe structure is reduced to a water content of 55 to 80% by weight.

The pipe structure formed reaches the terminal portion of the tubular passage of the shaping screen 9 as the tubular shaping screen 9 moves, and is removed from the inner wall surface of the shaping screen. The pipe structure so removed is heated at a temperature above the melting point of the termoplastic fibers (A) but below the melting point of the component (B). No particular restriction is imposed on the heating means. In the embodiment shown in FIG. 2, the pipe structure is further dried, and the thermoplastic fibers (A) are fused, in the heating oven 17. The heating temperature naturally differs according to the type of the thermoplastic fibers (A). Preferably, the maximum heating temperature is maintained at a point about 20° to 150° C. higher than the melting point of the thermoplastic fibers (A). The moving speed of the belt 19 within the heating furnace is made equal to the moving speed of the shaping screen 9. The press core supporting arm 22 can be made hollow to permit a cooling medium such as water to flow therethrough from one end 24 of the arm and thus to restrict the temperature of that portion of the supporting arm which is within the heating oven to below a certain temperature. The pipe structure which has left the heating oven 17 can be pressed by the press device described hereinabove before cooling and solidification. The shape of the press core is made to conform to the shape of the inside of the final product. The degree of pressing can be chosen as desired. The pressed pipe structure is further removed, and cut to the desired length to form the final product.

Thus, a gas-permeable seamless pipe structure having the desired length, thickness, density and gas permeability can be produced continuously.

The following Examples illustrate the present invention.

EXAMPLE 1

An apparatus of the type shown in FIG. 1 consisting of a cylindrical shaping screen with an inside diameter of 100 mm and a length of 250 mm made of two 40-mesh net-like belts, a core member with an outside diameter of 60 mm and a slurry feed means with an outside diameter of 89 mm and an inside diameter of 77 mm was used. The two 40-mesh net-like belts were moved at a rate of 2 meters while being in contact with the inside surface of the vacuum-sucking cylindrical shaping screen.

700 parts of high-density polyethylene fibers (with an average length of 1.8 mm and an average diameter of 80 microns) and 100 parts of polyester fibers (with an average length of 5 mm and an average diameter of 15 microns) were placed in 100,000 parts of water containing polyvinyl alcohol, and they were well stirred and mixed by a pulper. Then, 200 parts of "Shirasu" balloons (expanded volcanic ash with an apparent density of 0.06 and a particle diameter of 600 to 1,200 microns) were added, and mixed with the above mixture to such an extent that did not break the Shirasu balloons. The resulting slurry was continuously fed to the shaping screen at a rate of 90 liters/minute, and a seamless pipe structure was removed from the other end of the shaping screen. the pipe structure was dried and heated by passing it through a hot air drier maintained at 180° C. The resulting pipe had an outside diameter of 75 mm, an inside diameter of 65 mm and a density of 0.41 g/cm$^3$.

EXAMPLE 2

100 liters of water was mixed with 600 g of high-density polyethylene fibers (with an average length of 1.8 mm and an average diameter of 80 microns) and 100 g of polyvinyl formal fibers (with an average length of 7 mm and an average diameter of 10 microns), and 300 g of Shirasu balloons (with an apparent density of 0.06 and a particle diameter of 600 to 1,200 microns) were added to form a starting slurry.

The slurry was fed to a moving shaping screen with a cylindrical periphery while exerting a sucking action on it in a direction at right angles to the moving direction of the shaping screen, thereby to deposit a mixture of the fibers and the Shirasu balloons. The resulting seamless pipe structure was continuously dried and heated at 180° C. to fuse the polyethylene fibers sufficiently, followed by cooling. A pipe structure with a hard rough surface was obtained which had an outside diameter of 40 mm, an inside diameter of 26 mm, a wall thickness of 7 mm, and a weight of 200 g/m. It has a tensile strength (JIS K6760) of 40 Kg/cm$^2$ and a gas permeability of 2 Gurley seconds. One end of the pipe structure was closed by a stopper. and a water pressure of 0.1 Kg/cm$^2$ was exerted on the other end, whereupon water flowed from the pipe surface at a rate of 100 liters/min./m. This pipe structure was useful as a water supply pipe for seedling beds in agriculture and horticulture.

EXAMPLE 3

700 g of polypropylene fibers (with an average length of 25 mm and an average diameter of 40 microns) produced by melt spinning and 100 g of polyester fibers (with an average length of 5 mm and an average diameter of 15 microns) were placed in 100 liters of water containing polyvinyl alcohol. They were sufficiently stirred and mixed by a pulper, and then 200 g of hollow microspheres of a phenol resin (with an apparent density of 0.06 and a particle diameter of 60 to 120 microns) were added. They were mixed to an extent such that the hollow microspheres did not break. Using the resulting slurry, a seamless pipe structure was formed in the same way as in Example 2. It was continuously dried and heated at 200° C., and then pressed to form a pipe structure having an outside diameter of 40 mm, an inside diameter of 30 mm and a density of 0.5. The pipe structure had a Gurley gas permeability of 50 seconds.

What we claim is:

1. An apparatus for producing a gas-permeable seamless pipe structure comprising a tubular shaping screen movable in its axial direction; a suction chamber, provided upstream in the moving direction of the screen surrounding the outer wall surface of the shaping screen, for sucking the solid component of a slurry consisting of (A) 20 to 95% by weight of thermoplastic fibers, (B) 5 to 80% by weight of a component consisting of (a) 20 to 100% by weight of other fibers being infusible at the fusing temperature of the thermoplastic fibers (A) or having a higher melting point than said thermoplastic fibers (A) and (b) 0 to 80% by weight of a void-containing particulate material having an apparent density of not more than 1 and an average particle size of 20 to 20,000 microns and being infusible at the fusing temperature of the thermoplastic fibers (A), and (C) a liquid medium to the inner wall surface of the shaping screen and depositing it thereon in the form of a pipe structure; a slurry feed means for feeding the slurry onto the inner wall surface of the screen at the site of the suction chamber upstream in the moving direction of the screen; a core member in a tubular passageway formed by the shaping screen, said core member being disposed along the axial direction of the tubular passageway and at a position spaced from the inner wall surface of the shaping screen; and a heating means for withdrawing the deposited pipe structure from the terminal portion of the tubular passageway and heat-fusing the thermoplastic fibers of the pipe structure.

2. The apparatus of claim 1 wherein the core member is of a hollow structure and a number of small apertures for releasing a gas are provided on the peripheral wall of the hollow core member, and another suction chamber is provided surrounding that portion of the outer wall surface of the shaping screen which is opposite to the apertured portion.

* * * * *